US005752127A

United States Patent [19]

Okado et al.

[11] Patent Number: 5,752,127

[45] Date of Patent: May 12, 1998

[54] IMAGE FORMING APPARATUS PROVIDED WITH A MOVEMENT CONTROL MECHANISM FOR OPTICAL SYSTEM

[75] Inventors: Makoto Okado; Yoshihiro Ueda; Tadashi Kobata; Masami Taniguchi, all of Osaka, Japan

[73] Assignee: Mita Industrial Co., Ltd., Osaka, Japan

[21] Appl. No.: 814,847

[22] Filed: Mar. 11, 1997

[30] Foreign Application Priority Data

Mar. 13, 1996 [JP] Japan ..... 8-056000

[51] Int. Cl.[6] ..... G03G 15/041

[52] U.S. Cl. ..... 399/76; 399/201; 399/202

[58] Field of Search ..... 399/51, 76, 201, 399/202

[56] References Cited

U.S. PATENT DOCUMENTS 4,521,100 6/1985 Yonemori et al. ..... 399/201
4,571,064 2/1986 Hayashi et al. ..... 399/201
4,582,418 4/1986 Kozuka et al. ..... 399/201 X
4,627,708 12/1986 Arai et al. ..... 399/202

*Primary Examiner*—Nestor R. Ramirez
*Attorney, Agent, or Firm*—Jordan and Hamburg

[57] ABSTRACT

This invention relates to an image forming apparatus of electro-photography type in which a light image obtained by reflected light from an original document image by projecting light onto the original document image is changed in size at a set magnification rate to form an electrostatic latent image on a photosensitive member, and the electrostatic latent image is developed into a toner image. The image forming apparatus includes: a magnification rate setting unit with a lens and a reflective mirror for determining a magnification rate of the light image; lens moving means for moving the lens between a first position and a second position; reflective mirror moving means for moving the reflective mirror between a third position and a fourth position along the optical path; and movement controlling means for controlling the lens moving means to move the lens and the reflective mirror between the first position and the second position and between the third position and the fourth position by respective predetermined distances upon receiving a command signal.

5 Claims, 3 Drawing Sheets

IMAGE FORMING APPARATUS PROVIDED WITH A MOVEMENT CONTROL MECHANISM FOR OPTICAL SYSTEM

BACKGROUND OF THE INVENTION

This invention relates to an image forming apparatus of an electro-photography type, and more particularly to an image forming apparatus provided with a movement control mechanism of controlling an initial movement of an optical system provided in the image forming apparatus with high precision.

Conventionally, there have been known image forming apparatuses of electro-photography type in which light projected on a document surface is reflected therefrom and is introduced to a surface of a photosensitive drum by reflective mirrors to form an electrostatic latent image on the photosensitive drum surface, and the latent image is developed into a toner image to be transferred onto a copy sheet, thereby conducting an image formation. Such image forming apparatus is provided with optical means including a lens unit and reflective mirrors which are disposed on their respective specified positions along an optical path for introducing the reflected light to the photosensitive drum surface. Moving the lens unit and the reflective mirrors relative to each other in a specified direction along the optical path makes it possible to vary a scaling of the latent image relative to an original document image to thereby execute an image formation at a specified enlargement/reduction rate (i.e., specific magnification ratio) as well as at an identical rate with the original document image (i.e., no size change).

Specifically, driving rods for respectively driving the lens unit and reflective mirrors are coupled to a motor such as a stepping motor via a drive transmission mechanism including gears each having a specified deceleration ratio. When the motor is rotated, the driving rods are driven to move the lens unit and the reflective mirrors in association with each other in a specified direction by a travel amount corresponding to a set enlargement/reduction rate (magnification ratio).

In transporting the above-constructed image forming apparatus, the lens unit and the reflective mirrors are temporarily but firmly fixed to a main body of the apparatus, e.g., at their respective home positions by fixing means and the like to avoid a damage or breakage of the lens unit and the reflective mirrors due to an abrupt movement thereof during transportation. The home position is a position at which an image can be formed at an identical size to the original document image.

In installing the apparatus, the fixing means is removed from the apparatus main body, and a main switch for the image forming apparatus is turned on to supply power thereto, and so-called "initial movement" of the optical means is performed. Specifically, in turning on of the apparatus, the initial movement is performed so as to locate the lens unit and the reflective mirrors to their respective home positions in the following manner.

When the image forming apparatus is turned on, the motor for driving the optical means is driven to move the lens unit and the reflective mirrors in a first direction away from their respective home positions by a specified amount and then to return the same in a second direction opposite to the first direction toward their respective home positions after having moved in the first direction by the specified amount. Upon detection that the lens unit has passed the home position during the returning in the second direction, driving of the motor is suspended to stop the movement of the lens unit and the reflective mirrors.

The conventional image forming apparatus has suffered the following problems. Since the lens unit and the reflective mirrors are firmly fixed to the apparatus main body by fixing means during transportation, viscosity of lubricant on the gears of the drive transmission mechanism remains relatively high during the transportation. Accordingly, when power is turned on after removal of the fixing means to execute the initial movement of the optical means, load of the drive transmission mechanism is raised due to the viscosity of lubricant which remained relatively high during the transportation. The viscosity of lubricant is returned to a specified low level as the optical means travels back and forth with undergoing high friction. However, if the driving of the motor for the initial movement is suspended before the viscosity returns to the specified low level, i.e., before elapsing a sufficient time period for warming up of the optical means, rotation of the driving rods is delayed compared to an input of pulse signal to designate drive of the motor, thereby generating a time lag between start of the driving of the rods and input of pulse signal to designate drive of the motor. As a result, the actual travel amount of the reflective mirrors is likely to become smaller than a corresponding number of pulses which have been transmitted to the motor for driving the optical means due to a relatively higher load (reflected by the higher viscosity) in the drive transmission mechanism.

In the above-constructed image forming apparatus, even if the lens unit is returned to the home position after the initial movement, there may be a possibility that the reflective mirrors are not accurately positioned at their respective home positions with the result that a defocused (blurred) copy image may be obtained.

SUMMARY OF THE INVENTION

In view of the above, it is an object of the invention to solve the above drawbacks residing in the prior art.

It is another object of the invention to provide an image forming apparatus capable of setting a lens unit and reflective mirrors at their respective home positions with high precision.

To accomplish the above objects, the present invention is directed to an image forming apparatus of electro-photography type in which a light image obtained by reflected light from an original document image by projecting light onto the original document image is changed in size at a set magnification rate to form an electrostatic latent image on a photosensitive member, and the electrostatic latent image is developed into a toner image which is to be transferred onto a copy sheet, the image forming apparatus comprises:

a magnification rate setting unit including a lens and a reflective mirror for introducing the reflected light toward the photosensitive member and for determining a magnification rate of the light image relative to the original document image;

lens moving means for moving the lens between a first position and a second position along an optical path for the reflected light;

reflective mirror moving means for moving the reflective mirror between a third position and a fourth position along the optical path for the reflected light in association with the lens moving means; and movement controlling means for controlling the lens moving means to move the lens between the first position and the second position by a first predetermined distance and for controlling the reflective mirror moving means to move the reflective mirror between the third position and the fourth position by a second predetermined distance upon receiving a command signal.

With this arrangement, by moving the lens and the reflective mirror by the relatively long distance, movement of the lens and the reflective mirror becomes smooth, thereby accurately positioning the lens and the reflective mirror at their respective home positions.

In one aspect of this invention the lens moving means may include a motor and a lens driving transmission mechanism disposed between the motor and the lens for converting a rotational movement of the motor into a reciprocal movement, and the reflective mirror moving means may include a reduction mechanism disposed between the motor and the reflective mirror and a reflective mirror driving transmission mechanism disposed between the motor and the reflective mirror for converting a rotational movement of the motor into a reciprocal movement.

With this arrangement, the lens driving transmission mechanism, the reduction mechanism and the reflective mirror driving transmission mechanism can be operated smoothly. Accordingly, the lens and the reflective mirror can be moved smoothly, thereby accurately returning the lens and the reflective mirror at their respective predetermined (home) positions.

Another aspect of this invention, the image forming apparatus may further comprise position controlling means for positioning the lens and the reflective mirror at respective home positions at which the light image is formed with the size identical to the original document image after the lens and the reflective mirror are moved by the movement controlling means.

With this arrangement, copying at the same magnification can be started immediately after power is supplied to the image forming apparatus, thereby enhancing operability of the apparatus.

Yet another aspect of this invention, the movement controlling means can be set to operate upon receiving a power signal, indicative that power is supplied to the image forming apparatus, as the command signal when power is supplied.

With this arrangement, the lens and the reflective mirror can be moved by the relatively long distance automatically upon supply of power to the image forming apparatus, thereby also enhancing operability of the apparatus.

Yet another aspect of this invention, the image forming apparatus may include judgment means for judging whether power is supplied to the image forming apparatus for the first time, and the movement controlling means is operable if it is judged that power is supplied thereto.

With this arrangement, the movement control means is operable only when the image forming apparatus is turned on for the first time (i.e., set-up operation of the image forming apparatus), and is no longer operable afterwards. Accordingly, time required for an operator to wait from start of power supply to the image forming apparatus until image formation is enabled can be reduced, once the set-up operation is finished, thereby also enhancing operability of the apparatus.

Moreover, the first predetermined distance (d1) and the second predetermined distance (d2) can be set by the following equations:

$d1 \geqq \alpha \cdot$(twice a distance between the first position and the second position);

$d2 \geqq \beta \cdot$(twice a distance between the third position and the forth position);

wherein the coefficient $\alpha=0.5$ and the coefficients $\beta=0.5$.

With this arrangement, the coefficients $\alpha$ and $\beta$ can be easily set so that most reliable moving distances of the lens and the reflective mirror respectively are being set for reliably restoring the inherent low viscosity of the lubricant oil applied on the driving transmission mechanism.

The above and other objects, features and advantages of the present invention will become more apparent upon a reading of the following detailed description and drawings.

DETAILED DESCRIPTION OF THE PREFERRED EMBODIMENTS OF THE INVENTION

Figure 1:
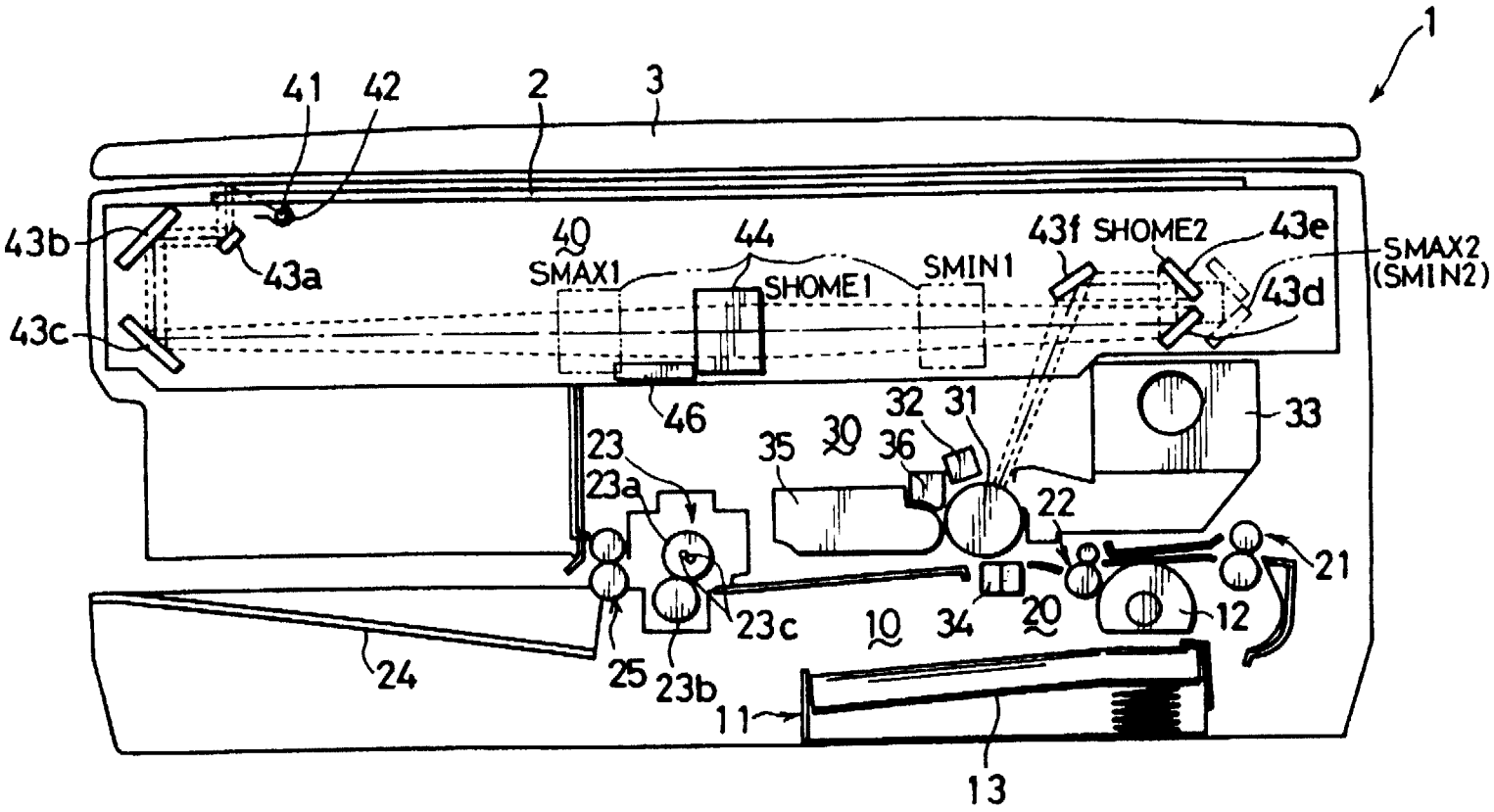
FIG. 1 is a front view showing an internal arrangement of an embodiment of an image forming apparatus according to this invention.

FIG. 1 is a front view showing an internal arrangement of an embodiment of an image forming apparatus provided with a movement control mechanism of this invention.

In FIG. 1, denoted at 1 is a main body of the image forming apparatus. The apparatus main body 1 comprises a sheet storage portion 10 disposed at a lower portion thereof, a sheet transport unit 20 disposed above the sheet storage portion 10, an imaging assembly 30 arranged above the sheet transport unit 20, and an optical system 40 disposed above the imaging assembly 30. The apparatus main body 1 further has a contact glass 2 arranged in the middle of a top portion thereof, and a document presser 3 for pressing a document placed on the contact glass 2 by a specified pressure.

The sheet storage portion 10 comprises a cassette 11 and a feed roller 12 which is disposed on the right end side, above the cassette 11 in FIG. 1. The cassette 11 has a sheet placement plate 13 with a lead end thereof urged upward by a spring to stack copy sheets thereon. The feed roller 12 has an a substantially semicircle in cross section and includes a flat portion and a curved portion. When in a stationary state, the feed roller 12 is set such that the flat portion faces the cassette 11 so as not to obstruct mounting and dismounting operations of the cassette in and out of the apparatus main body.

The optical system 40 includes an exposure lamp 41, reflector 42, reflective mirrors 43*a*, 43*b*, 43*c*, 43*d*, 43*e*, and 43*f*, lens unit 44, and unillustrated optical system moving means. The optical system moving means is adapted for moving the exposure lamp 41, reflector 42, and reflective mirrors 43*a* at a specified speed V, and for moving the reflective mirrors 43*b* and 43*c* at a specified speed ½ V respectively in right and left side directions on the plane in FIG. 1 (hereinafter also referred to as "scan direction"). When these elements of the optical system 40 are traveled reciprocally within a specified area to scan an image of an original document placed on the contact glass 2, a light image of document image is formed on a surface of a photosensitive drum 31 which is described later.

The optical system 40 comprises an optical system drive circuit 45 (see FIG. 2), home position detecting switch (hereinafter merely referred to as HP switch) 46 for detecting the home position of the lens unit 44, lens moving means 47 (see FIG. 2) for reciprocally moving the lens unit 44 within the specified area in accordance with a set scaling, and reflective mirror moving means (hereinafter merely referred to as RM moving means) 48 for reciprocally moving the reflective mirrors 43*d* and 43*e* in accordance with the set scaling.

The lens unit 44 is adapted for changing a scaling of the light image relative to the document image which is to be formed on the surface of the photosensitive drum 31 by being moved to a specified position in the scan direction. The reflective mirrors 43*d* and 43*e* are adapted for focusing the light image on the surface of the photosensitive drum 31 by being moved to their respective specified positions in the scan direction in accordance with a moved amount of the lens unit 44. The reflective mirrors 43*d* and 43*e* are moved in association with the lens unit 44.

The imaging assembly 30 has the photosensitive member 31 in the form of a drum which is rotatably supported about its rotational axis, and further comprises a main charger 32, developing unit 33, transfer/separation unit 34, cleaner 35, and blank lamp 36 in the periphery of the photosensitive drum 31 from upstream side in this order with respect to the rotating direction of the photosensitive drum 31.

The main charger 32 charges a surface of the photosensitive drum 31 uniformly at a specified potential. A specified area of the photosensitive drum surface, immediately downstream of the main charger 32 is exposed to a light image of original document image directed from the optical system 40 to form an electrostatic latent image thereon. The developing unit 33 is adapted for developing the latent image into a toner image by electrically attracting charged toner particles to the latent image. The transfer/separation unit 34 is adapted for transferring the toner image onto a copy sheet and separating the same after the image transfer from the surface of the photosensitive drum 31. The cleaner 35 is adapted for removing residues of toner particles on the photosensitive drum surface after the image transfer, and the blank lamp 36 is adapted for removing residues of electric charges on the photosensitive drum surface.

The sheet transport unit 20 comprises a transport roller pair 21, a registration roller pair 22, a fixing unit 23, a discharge tray 24, and a discharge roller pair 25 arranged from upstream side in this order with respect to the sheet transport direction. Specifically, a copy sheet dispensed from the sheet storage portion 10 is fed toward the photosensitive member 31 by the transport roller pair 21, transported further downstream by the registration roller pair 22 as timed with a scan timing of the optical system 40, and discharged onto the discharge tray 24 via the discharge roller pair 25 after having a toner image fixed thereon in the fixing unit 23.

The fixing unit 23 comprises a heater roller 23*a* and a presser roller 23*b*. The heater roller 23*a* is internally provided with a heater 23*c* and is maintained at a specified temperature to optimally fix the transferred toner image onto a copy sheet. The presser roller 23*b* has a surface thereof made of a material slightly softer than the surface of the heater roller 23*a* and is pressed against the heater roller 23*a* with a specified pressing force.

A movement control mechanism for controlling the initial movement of the optical system is described with reference to FIGS. 2 and 3.

Figure 2:
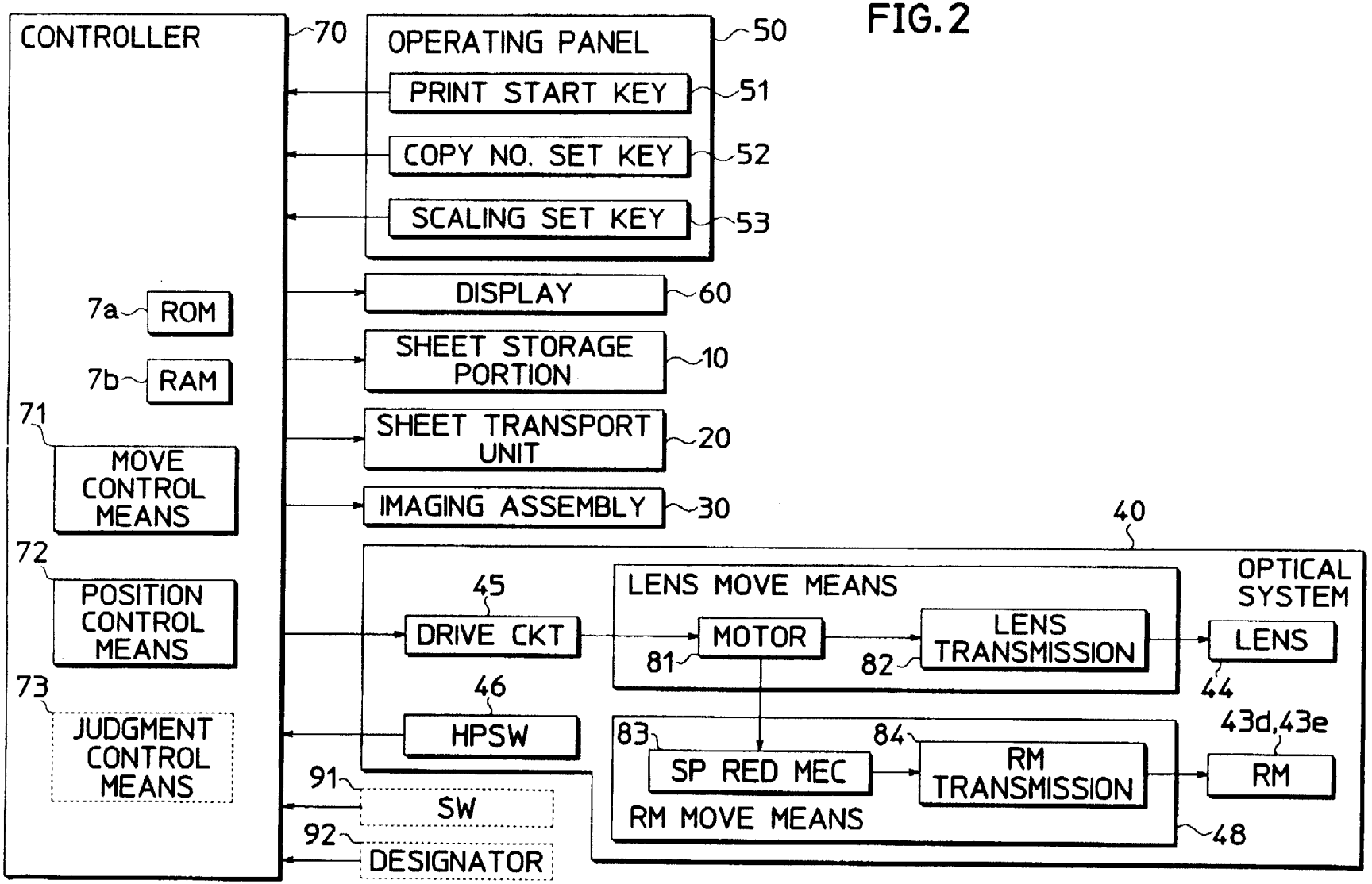
FIG. 2 is a block diagram showing a control system of the image forming apparatus.
Figure 3:
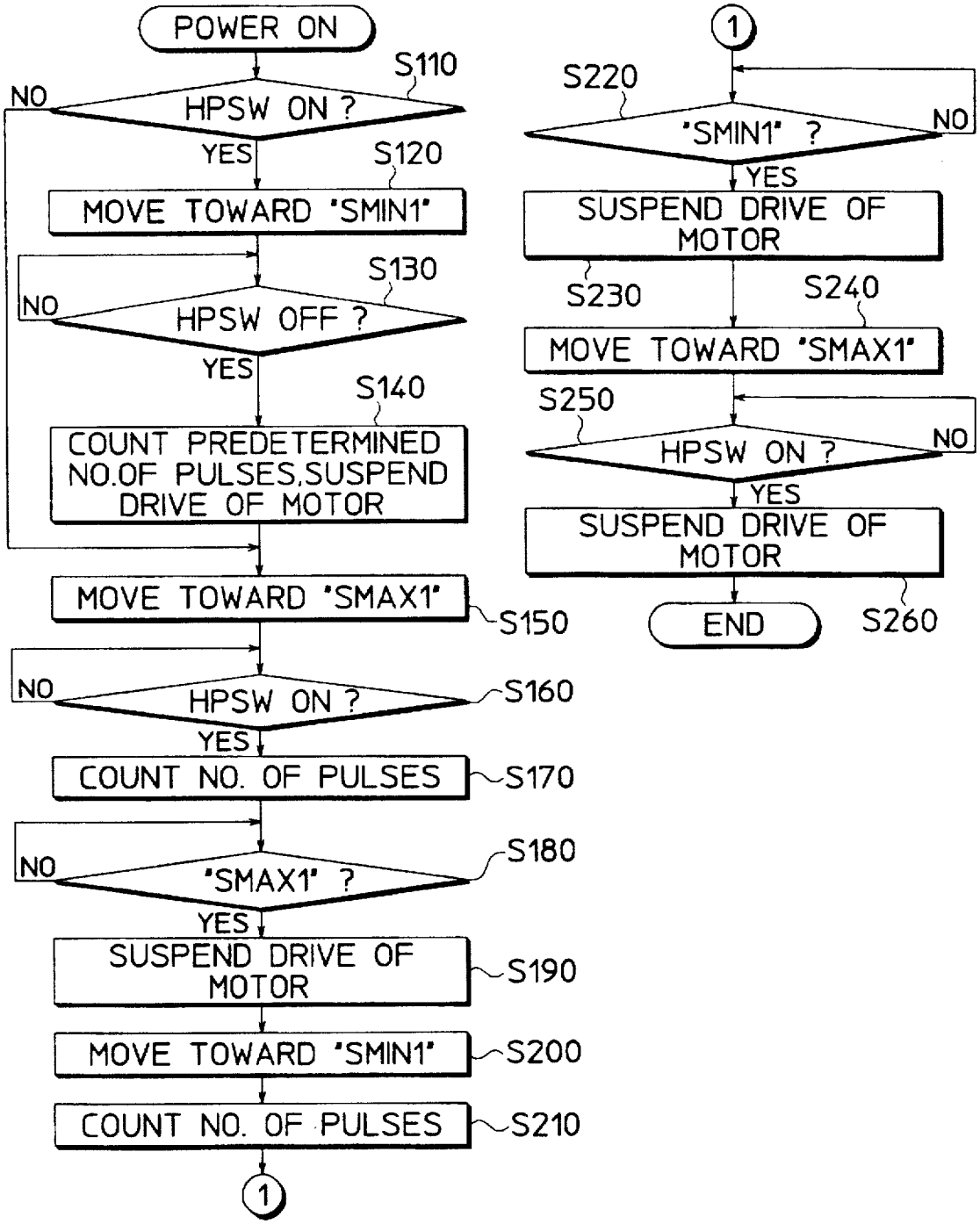
FIG. 3 is a flowchart showing operation procedures of the control system when power is supplied to the image forming apparatus.

FIG. 2 is a block diagram showing a control system of the image forming apparatus provided with the movement control mechanism according to the present invention. The image forming apparatus comprises a controller 70 including a microcomputer. The controller 70 controls various operations of the image forming apparatus.

The lens moving means 47 of the optical system 40 includes a lens driving motor 81 such as a pulse motor and a lens driving force transmission mechanism 82 (hereinafter also referred to as a lens driving transmission), while the RM moving means 48 of the optical system 40 includes a speed reduction mechanism 83 and a reflective mirror driving force transmission mechanism (hereinafter also referred to as RM driving transmission) 84.

The drive circuit 45 of the optical system 40 includes a transistor and is adapted for supplying a drive pulse to the lens driving motor 81. The number of drive pulses is controlled by the controller 70. A rotating amount of the motor 81 is controlled based on the number of drive pulses which is supplied to the motor 81 from the drive circuit 45, and a rotating direction, i.e., forward or reverse direction of the motor 81 is controlled by inverting the polarity.

The lens driving transmission 82 of the lens moving means 47 includes a ball screw mechanism which converts a rotational force of the motor 81 into a reciprocal movement (i.e., linear motion) of the lens unit 44, and is adapted for transmitting the rotational force of the motor 81 to the lens unit 44 to move the same reciprocally in the scan direction of the optical system 40.

The speed reduction mechanism 83 (or simply a reduction mechanism) of the RM moving means 48 includes a group of gears to reduce the rotational speed of the motor 81 in accordance with a predetermined reduction ratio. The reduction ratio is predetermined to such a level that the reflective mirrors 43*d* and 43*e* are moved in accordance with a moved amount of the lens unit 44 so as to constantly focus the light image on the specified image exposure area of the photosensitive drum surface.

The RM driving transmission 84 includes a ball screw mechanism which converts a rotational force of the motor 81, whose traveling speed is reduced by the speed reduction mechanism 83, into a reciprocal movement of the reflective mirrors 43*d* and 43*e*. The RM moving means 48 drivingly moves the reflective mirrors 43*d* and 43*e* in the scan direction of the optical system 40 in association with the movement of the lens unit 44.

The HP switch 46 of the optical system 40 is a light transmitting type photo sensor which detects the position of the lens unit 44, and is operated in such a manner that the switch 46 is turned to an ON-state when the lens unit 44 is located at a specified position for the identical size copying (i.e., home position) or at a position for size enlargement copying, while being turned to an OFF-state when the lens unit 44 is located at a specified position for size reduction copying.

The image forming apparatus further comprises an operating panel 50 and a display 60. The operating panel 50 is arranged at an appropriate position on the top portion of the apparatus main body 1, and includes various operation keys such as print start key 51 for designating start of copying, number of copy set key (ten keys) 52 for setting the number of copies to be made for each original document, and scaling set key (or magnification rate setting key) 53 for setting the enlargement/reduction rate for copying.

The display 60 is also arranged at an appropriate position on the top portion of the apparatus main body 1. The display 60 comprises a liquid crystal display (LCD) panel and light emitting diode (LED) and is adapted for displaying the number of copy set by the ten keys 52 and the enlargement/reduction rate set by the scaling set key 53 and so forth.

The controller 70 includes a ROM 7a for storing a control program and predetermined data which will be described later, and a RAM 7b for temporarily storing various data. When the print start key 51 is depressed, the controller 70 controls the sheet transport unit 20, imaging assembly 30 and optical system 40 in accordance with the contents set by the various operation keys such as scaling set key 53, thereby initiating copying operation.

The controller 70 further comprises movement control means 71 and position control means 72. The movement control means 71 is, as will be described later with reference to FIG. 3, adapted for controlling operations of the lens moving means 47 and RM moving means 48 via the drive circuit 45 when power of the apparatus main body 1 is turned on. The position control means 72 is, as will also be described in FIG. 3, adapted for controlling operations of the lens moving means 47 and RM moving means 48 via the drive circuit 45 after the control operations of the movement control means 71, thereby moving the lens unit 44 and the reflective mirrors 43d and 43e to their respective home positions for identical size copying operation.

The controller 70 further controls the lens moving means 47 and RM moving means 48 via the drive circuit 45 to move the lens unit 44 and reflective mirrors 43d and 43e at their respective positions suitable for copying at the enlargement/reduction rate set by the scaling set key 53.

Specifically, when the identical size copying operation is carried out, the lens unit 44 and the reflective mirrors 43d and 43e are moved to their respective home positions $S_{HOME1}$, $S_{HOME2}$ shown by the solid lines in FIG. 1. When copying at a specified magnification is conducted, the lens unit 44 is moved to the left from the home position $S_{HOME1}$ and the reflective mirrors 43d and 43e are moved to the right from their respective home positions $S_{HOME2}$. At the maximum magnification, the lens unit 44 is moved to the utmost leftward position $S_{MAX1}$ shown by the phantom line in FIG. 1, while the reflective mirrors 43d and 43e are moved to their respective utmost rightward positions $S_{MAX2}$ also shown by the phantom lines in FIG. 1.

On the contrary, when copying at a specified reduction ratio is conducted, the lens unit 44 is moved to the right from the home position $S_{HOME1}$ in FIG. 1, while the reflective mirrors 43d and 43e are moved in the right side direction from the home positions $S_{HOME2}$ in FIG. 1. At the maximum reduction ratio, the lens unit 44 is moved to the utmost rightward position $S_{MIN1}$ shown by the phantom line in FIG. 1, while the reflective mirrors 43d and 43e are moved to their respective utmost rightward positions $S_{MIN2}$ also shown by the phantom lines in FIG. 1. It is to be appreciated that the positions $S_{MAX2}$ and $S_{MIN2}$ for the reflective mirrors 43d and 43e at the maximum magnification and reduction ratios are the same.

The ROM 7a stores the number of pulses $n_1$ to be supplied to the motor 81 to move the lens unit 44 and the reflective mirrors 43d and 43e from their respective home positions $S_{HOME1}$ and $S_{HOME2}$ toward the positions $S_{MAX1}$ and $S_{MAX2}$ together at the set magnification ratio, in correspondence with the number of pulses $n_2$ to be supplied to the motor 81 to move the lens unit 44 and the reflective mirrors 43d and 43e from their respective home positions $S_{HOME1}$ and $S_{HOME2}$ toward the positions $S_{MIN1}$ and $S_{MIN2}$ together with the set reduction ratio.

It is to be noted that the number of pulses to be supplied to the motor 81 for moving the lens unit 44 and the reflective mirrors 43d and 43e from their respective home positions $S_{HOME1}$, $S_{HOME2}$ to the positions $S_{MAX1}$ and $S_{MAX2}$ is set at the value $N_1$, whereas the number of pulses to be supplied to the motor 81 for moving the lens unit 44 and the reflective mirrors 43d and 43e from their respective home positions $S_{HOME1}$, $S_{HOME2}$ to the positions $S_{MIN1}$ and $S_{MIN2}$ is set at the value $N_2$.

Next, how an image is formed with the image forming apparatus incorporated with the movement control mechanism of this invention is described.

When an operator sets the magnification rate by the scaling set key 53, designates the number of copies by the ten keys 52, and presses the print start key 51, copying is started.

Specifically, light emitted from the exposure lamp 41 projects a surface of an original document set on the contact glass 2 from where the reflected light is introduced to the lens unit 44 via the reflective mirrors 43a, 43b and 43c. Thereafter, the reflected light is directed to a specified image exposure area on the surface of the photosensitive drum 31 by way of the reflective mirrors 43d and 43e. At this time, the surface of the photosensitive drum 31 is uniformly charged by the main charger 31, and the specified image exposure area of the photosensitive drum surface is exposed to the light image to form an electrostatic latent image thereon. Subsequently, charged toner particles supplied from the developing unit 33 is electrically attracted to the latent image to develop the latent image into a toner image.

In the sheet storage portion 10, copy sheets stacked on the sheet placement plate 13 of the cassette 11 are fed one by one from the uppermost copy sheet by the feed roller 12 when the feed roller 12 is driven and the uppermost copy sheet is given a friction force between the curved portion of the feed roller 12 and the upper surface of the uppermost copy sheet. The thus fed copy sheet is transported by the transport roller pair 21 toward the imaging assembly, and is further transported to a clearance between the photosensitive drum 31 and the transfer/separation unit 34 by the registration roller pair 22 as timed with a scanning operation of the optical system 40.

In the transfer/separation unit 34, the copy sheet has the toner image transferred from the photosensitive drum surface onto the copy sheet, separated from the drum surface and is transported to the fixing unit 23. In the fixing unit 23, the copy sheet has the transferred toner image fixed thereon with heat of the heater roller 23a and a pressing force of the presser roller 23b, while passing between the rotating heater roller 23a and presser roller 23b. After the fixation, the copy sheet is discharged onto the discharge tray 24 via the discharge roller pair 25. Thus, copy sheets after the image formation are discharged on the discharge tray 24 one after another.

Next, control operations of the control system for controlling initial movement of the optical system 40, specifically, the lens unit 44 and the reflective mirrors 43d and 43e are described with reference to a flowchart in FIG. 3.

First, it is judged whether the home position switch 46 (in FIG. 3, indicated at HPSW) is turned to an ON-state or OFF-state in Step S110. If it is judged that the switch 46 is turned to an ON-state (YES in Step S110), the motor 81 is driven to move the lens unit 44 to the right in FIG. 1, i.e., toward the $S_{MIN1}$ position in Step S120. Then, it is judged whether the HP switch 46 is turned to an OFF-state in Step S130. If it is judged that the switch 46 is in the ON-state (NO in Step S130), the movement of the lens unit 44 toward $S_{MIN1}$ is carried on.

When it is judged that the switch 46 is turned to an OFF-state (YES in Step S130), the driving of the motor 81 is suspended after rotating by a predetermined number of pulses in Step S140. Then, this operation flow proceeds to Step S150. Thus, the lens unit 44 is reliably moved toward $S_{MIN1}$ from the home position $S_{HOME}$.

On the other hand, if it is judged that the HP switch 46 is in the OFF-state (NO in Step S110), it means that the lens unit 44 is located on the right side from the home position $S_{HOME1}$ in FIG. 1, i.e., at a position for reduced size copying. Then, the motor 81 is driven to move the lens unit 44 to the left in FIG. 1, i.e., toward the position $S_{MAX1}$ in Step S150.

Subsequently, it is judged whether the HP switch 46 is turned to an ON-state in Step S160. If it is judged that the switch 46 is in an OFF-state (NO in Step S160), the lens unit 44 is continued to be moved toward the position $S_{MAX1}$. When it is judged that the switch 46 is turned to an ON-state (YES in Step S160), it means that the lens unit 44 is positioned at the home position $S_{HOME1}$. Then, the number of pulses to be supplied to the motor 81 is counted from the timing at which the switch 46 is turned from an OFF-state to an ON-state in Step S170.

Movement of the lens unit 44 is continued until the number of pulses supplied to the motor 81 coincides with the value $N_1$, (NO in Step S180). When the number of pulses coincides with the value $N_1$ i.e., $n_1=N_1$, (YES in Step S180), the driving of the motor 81 is suspended in Step S190. Subsequently, the motor 81 is driven to move the lens unit 44 in the right side direction in FIG. 1., i.e., toward the position $S_{MIN1}$ in Step S200, and the number of pulses to be supplied to the motor 81 is started to be counted in Step S210.

Movement of the lens unit 44 is continued until the number of pulses to be supplied to the motor 81 coincides with the value $(N_1+N_2)$(NO in Step S220). The value $(N_1+N_2)$ corresponds to a traveling amount for the lens unit 44 to travel from the position $S_{MAX1}$ to the position $S_{MIN1}$.

When the number of pulses coincides with the value $(N_1+N_2)$ (YES in Step S220), the driving of the motor 81 is suspended in Step S230. Subsequently, the motor 81 is driven to move the lens unit 44 in the left side direction in FIG. 1, i.e., toward $S_{MAX1}$ in Step S240.

Then, it is judged whether the HP switch 46 is turned to an ON-state in Step S250. If it is judged that the HP switch 46 is in an OFF-state (NO in Step S250), the movement of the lens unit 44 toward $S_{MAX1}$ is continued. On the other hand, if it is judged that the HP switch 46 is turned to an ON-state (YES in Step S250), the driving of the motor 81 is suspended, thereby positioning the lens unit 44 exactly at the $S_{HOME1}$ position in Step S260.

In the above flowchart, description on the movement of the reflective mirrors **43*d* and 43*e* is omitted. However, it is to be understood that the reflective mirrors 43*d* and 43*e* are moved from $S_{HOME2}$ to $S_{MAX2}$ ($S_{MIN2}$) in association with the lens unit 44 which is moved from $S_{HOME1}$ to $S_{MAX1}$ ($S_{MIN1}$). More specifically, when the lens unit 44** travels by a specified distance from $S_{HOME1}\rightarrow S_{MAX1}\rightarrow S_{HOME1}\rightarrow S_{MIN1}\rightarrow S_{HOME1}$, the reflective mirrors travel by a specified distance from $S_{HOME2}\rightarrow S_{MAX2}\rightarrow S_{HOME2}\rightarrow S_{MIN2}\rightarrow S_{HOME2}$.

In the above embodiment, when power is supplied to the image forming apparatus, the lens unit 44 and the reflective mirrors **43*d* and 43*e* are returned to their respective home positions, $S_{HOME1}$ and $S_{HOME2}$ after moving by the distance corresponding to the reciprocal moved amount of the lens unit 44 (and the reflective mirrors 43*d* and 43*e*) between $S_{MAX1}$ ($S_{MAX2}$) and $S_{MIN1}$ ($S_{MIN2}$). Accordingly, there can be eliminated the possible adverse effects due to the load (positive relation with a viscosity) of the optical system driving transmission mechanism which results from fixation of these optical elements (lens unit 44 and the reflective mirrors 43*d* and 43*e***) during transportation of the image forming apparatus.

More specifically, the lens unit 44 and the reflective mirrors **43*d* and 43*e* are firmly attached to the apparatus main body and have their movements restricted during transportation of the image forming apparatus. Accordingly, viscosity of lubricant in the lens driving transmission 82, speed reduction mechanism 83 and RM driving transmission 84 has been increased during the transportation. However, the above initial movement of the optical elements, which is conducted immediately after power is supplied to the image forming apparatus, warms up these optical elements and can surely return the increased viscosity of lubricant to the inherent low level, thereby assuredly returning the lens unit 44 and the reflective mirrors 43*d* and 43*e* to their respective home positions, while securing smooth movement of the lens unit 44 and the reflective mirrors 43*d* and 43*e*** afterwards.

The present invention is not limited to the above but can take various modifications such as (1) to (4) shown below.

(1) In the foregoing embodiment, the lens unit 44 (and the reflective mirrors **43*d* and 43*e*) are moved by the whole traveling distance from $S_{MAX1}$ ($S_{MAX2}$) to $S_{MIN1}$ ($S_{MIN2}$). However, in this modification, the lens unit 44 (and the reflective mirrors 43*d* and 43*e*) are moved by a relatively long distance between $S_{MAX1}$ ($S_{MAX2}$) and $S_{MIN1}$ ($S_{MIN2}$), which is sufficient enough to eliminate the adverse effects due to the load of the transmission mechanism for driving the optical elements such as the lens unit 44 and the reflective mirrors 43*d* and 43*e*** and to return the viscosity of lubricant to its inherent low level. To more reliably attain the above effects, it may be preferable that the optical elements are moved substantially close to $S_{MAX1}$ ($S_{MAX2}$) and to $S_{MIN1}$ ($S_{MIN2}$).

Alternatively, the lens unit 44 (and the reflective mirrors **43*d* and 43*d***) may be moved from $S_{HOME1}$ ($S_{HOME2}$) to either one way, i.e., to $S_{MAX1}$ ($S_{MAX2}$) or to $S_{MIN1}$ ($S_{MIN2}$), and then returned to $S_{HOME1}$ ($S_{HOME2}$). In either case, warm-up operation of the optical elements is conduced to accurately return the optical elements to their respective home positions, similar to the above embodiment. In particular, in this modification and in the alterations, time required from start of power supply to the image forming apparatus to enabling of copying operation can be reduced.

(2) In the foregoing embodiment, the movement control means 71 controls movements of the lens unit 44 and the reflective mirrors **43*d* and 43*e*** each time power is supplied to the image forming apparatus. However, in this modification, it may be appreciated that the movement control is executed only after the image forming apparatus is turned on for the first time, i.e., only in case that the image forming apparatus is set up.

In this modification, as shown by the dotted lines in FIG. 2, the image forming apparatus is provided with a judgment switch 91, while the controller 70 is provided with a judgment control means 73. The judgment switch 91 is arranged at an appropriate position on an agitating rod for agitating toner particles in the developing unit 33 and feeding the same to the photosensitive drum surface and is adapted for judging whether the developing unit 33 is a newly replaced one. Specifically, the judgment switch 91 is constructed in such a manner that the switch 91 is turned off when power is supplied to the image forming apparatus for the first time after the apparatus is installed and keeps its OFF-state thereafter.

The judgment control means 73 is adapted for judging whether the judgment switch 91 is in an OFF-state when the image forming apparatus is turned on and for transmitting a command signal to the movement control means 71 in accordance with a judgment result. If it is judged that the judgment switch 91 is in an ON-state, the controller 70 controls the movement control means 71 to render the lens unit 44 and the reflective mirrors 43*d* and 43*e* execute the initial movement.

On the other hand, if it is judged that the judgment switch 91 is in an OFF-state, the controller 70 controls the movement control means 71 to prohibit initial movement of the lens unit 44 and the reflective mirrors 43*d* and 43*e*. The judgment control means 73 is constructed in such a way that it judges whether the switch 91 is in an OFF-state or ON-state before the switch 91 is turned to an OFF-state upon power supply to the image forming apparatus for the first time.

With this arrangement, movement control of the optical elements is conducted only after the apparatus is set up and power is supplied to the apparatus for the first time to execute warm-up operation of the optical elements. In this modification, movement control (initial movement) of the optical elements is conducted only once together with the set-up operation of the image forming apparatus, and is never conducted thereafter. Accordingly, from a second time operation and thereafter there can be reduced the time from start of the power supply to the apparatus to enabling of copying operation, once the image forming apparatus is set up. Thus, an operator does not have to wait for a long time until the movement control of the optical elements is finished each time when the image forming apparatus is turned on.

It is to be noted that during the set-up operation of the apparatus, initial movement of the other members in the apparatus is required to be conducted. For instance, initial movement of the developing unit 33 requires a longer time than the initial movement of the optical system. Accordingly, an operator does not necessarily have to wait for a long time despite the fact that the movement control of the optical system is conducted when the apparatus is to be set up.

(3) In the second modification, the judgment switch 91 is provided in the developing unit 33. Alternatively, the photosensitive drum 31 may be provided with a circuit with a fuse to respond whether or not the photosensitive drum 31 is a newly replaced one. The fuse is included in the circuit to function in a manner that it is fused to open the circuit when power is supplied to the image forming apparatus for the first time.

In this modification, the judgment control means 73 judges whether the judgment switch (fuse) 91 develops a close loop circuit or is fused to open the circuit at the time when the image forming apparatus is turned on. If it is judged that the fuse develops a close loop circuit, the controller 70 allows the movement control means 71 to execute the movement control of the optical elements. On the other hand, if it is judged that the circuit is in an opened state, the controller 70 controls the movement control means 71 to prohibit the movement control of the optical elements. With this arrangement, warm-up operation of the optical elements can be conducted as in the second modification.

(4) In the above embodiment, each time when the image forming apparatus is turned on, the lens unit 44 and the reflective mirrors 43*d* and 43*e* are automatically moved for warm-up operation. However, as shown in FIG. 2, designator means 92 (e.g., switch) shown by the dotted line for instructing movement control of these optical elements may be provided. In this case, the movement control means 71 is operated to allow movement of the lens unit 44 and the reflective mirrors 43*d* and 43*e* upon receiving a command signal from the designator means 92 to move the same.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

What is claimed is:

1. An image forming apparatus of the electro-photography type in which a light image obtained by reflected light from an original document image by projecting light onto the original document image is changed in size at a set magnification rate to form an electrostatic latent image on a photosensitive member, and the electrostatic latent image is developed into a toner image which is to be transferred onto a copy sheet, the image forming apparatus comprising:

a magnification rate setting unit including a lens and a reflective mirror for introducing the reflected light toward the photosensitive member and for determining a magnification rate of the light image relative to the original document image;

lens moving means for moving the lens between a first position and a second position along an optical path for the reflected light;

reflective mirror moving means for moving the reflective mirror between a third position and a fourth position along the optical path for the reflected light in association with the lens moving means;

movement controlling means for controlling the lens moving means to move the lens between the first position and the second position by a first predetermined distance and for controlling the reflective mirror moving means to move the reflective mirror between the third position and the fourth position by a second predetermined distance upon receiving a command signal, the movement controlling means being set to operate upon receiving a power signal, indicative that power is supplied to the image forming apparatus, as the command signal when power is supplied; and judgment means for judging whether power is supplied to the image forming apparatus for the first time, the movement controlling means being operable if it is judged that power is supplied thereto.

2. An image forming apparatus according to claim 1, wherein the judgment means includes a judgment switch for changing a status of a circuit from close loop to an open loop when power is supplied to a developing unit and for having the open loop maintained regardless of the power supply thereafter and judgment controlling means for judging whether the judgment switch is in the close loop circuit or in the open loop circuit when power is supplied to the developing unit.

3. An image forming apparatus of the electro-photography type in which a light image obtained by reflected light from an original document image by projecting light onto the original document image is changed in size at a set magnification rate to form an electrostatic latent image on a photosensitive member, and the electrostatic latent image is developed into a toner image which is to be transferred onto a copy sheet, the image forming apparatus comprising:

a magnification rate setting unit including a lens and a reflective mirror for introducing the reflected light toward the photosensitive member and for determining a magnification rate of the light image relative to the original document image;

lens moving means for moving the lens between a first position and a second position along an optical path for the reflected light;

reflective mirror moving means for moving the reflective mirror between a third position and a fourth position along the optical path for the reflected light in association with the lens moving means; and movement controlling means for controlling the lens moving means to move the lens between the first position and the second position by a first predetermined distance and for controlling the reflective mirror moving means to move the reflective mirror between the third position and the fourth position by a second predetermined distance upon receiving a command signal;

the first predetermined distance (d1) and the second predetermined distance (d2) being expressed by the following equations:

$d1 \geqq \alpha \cdot$(twice the distance between the first position and the second position);

$d2 \geqq \beta \cdot$(twice the distance between the third position and the fourth position);

wherein the coefficient $\alpha=0.5$ and the coefficient $\beta=0.5$.

4. An image forming apparatus according to claim 3, wherein the coefficient $\alpha$ being 0.9 and the coefficients being 0.9.

5. An image forming apparatus according to claim 3, wherein the coefficient $\alpha$ being 1.0 and the coefficient $\beta$ being 1.0.

* * * * *